US005415010A

United States Patent [19]

Woo

[11] Patent Number: 5,415,010

[45] Date of Patent: May 16, 1995

[54] TABLE ATTACHED WITH REFRIGERATOR

[76] Inventor: Jong R. Woo, 255-14, Beomo-Dong, Suseong-Ku, Daegu, Rep. of Korea

[21] Appl. No.: 185,003

[22] Filed: Jan. 24, 1994

[51] Int. Cl.[6] ..... F25D 23/12

[52] U.S. Cl. ..... 62/258; 108/50; 312/22; 312/404

[58] Field of Search ..... 108/26, 50; 312/22, 312/27, 404; 62/258

[56] References Cited

U.S. PATENT DOCUMENTS

| | | | |
|---|---|---|---|
| 1,579,823 | 4/1926 | Langguth | 108/26 X |
| 2,768,047 | 10/1956 | Struass | 108/26 X |
| 3,021,185 | 2/1962 | Kowalczyk | 108/26 X |
| 3,364,882 | 1/1968 | Merrick | 108/50 X |
| 3,411,317 | 11/1968 | Swenson et al. | 108/50 X |
| 3,413,053 | 11/1968 | Featherston | 108/26 X |
| 4,274,686 | 6/1981 | White | 312/22 X |
| 4,747,352 | 5/1988 | Guidry et al. | 108/50 |

*Primary Examiner*—William E. Tapolcai

*Attorney, Agent, or Firm*—Birch, Stewart, Kolasch & Birch

[57] ABSTRACT

The present invention relates to a table having an attached refrigerator, and more particularly to a table having an attached refrigerator which is made such that a cavity is defined beneath the table and a refrigerating chamber is made. A moving table housed in the cavity is provided to be lifted up and dropped down within the cavity, and door plates are provided at the top surface of the cavity, so that a utilizing and storing of side dishes is made to be convenient on a table.

8 Claims, 6 Drawing Sheets

TABLE ATTACHED WITH REFRIGERATOR

BACKGROUND OF THE INVENTION

1. Field of the Invention

The present invention relates to a table having an attached refrigerator, and more particularly to a table having an attached refrigerator which is made such that a cavity is defined beneath the table and a refrigerating chamber is thus formed in the cavity, a moving table capable of putting side dishes on the cavity is provided so as to be lifted up and dropped down, and opening and closing door plates are provided at the top of the cavity, so that a utilizing and storing of side dishes are made to be convenient on a table.

2. Description of Related Art

In general, since the table normally only serves a function of supporting tablewares to take a meal, there has been an inconvenience that the side dishes have to be taken out of a refrigerator and put on the table before taking the meal and then the side dishes have to be put back into the refrigerator again for storage after taking the meal, therefore not only was much energy wasted, but also much meal preparing time was needed.

Therefore, in order to solve problems as above, an article attached with refrigerator to a table has been offered, however it has not been practically used because an operation of lifting up and dropping down of a moving table as well as opening and closing door plates were insufficient, and since its structure was complicated, much space was occupied.

SUMMARY OF THE INVENTION

The present invention, in order to solve these problems, is made so that an operation of storing and refrigerating the side dishes beneath the central portion of the table and then lifting up them on the table upon taking a meal is carried out in turn.

DETAILED DESCRIPTION OF THE PREFERRED EMBODIMENT

A preferred embodiment of the present invention in more detail with reference to the accompanying drawings will be as follows.

Figure 1:
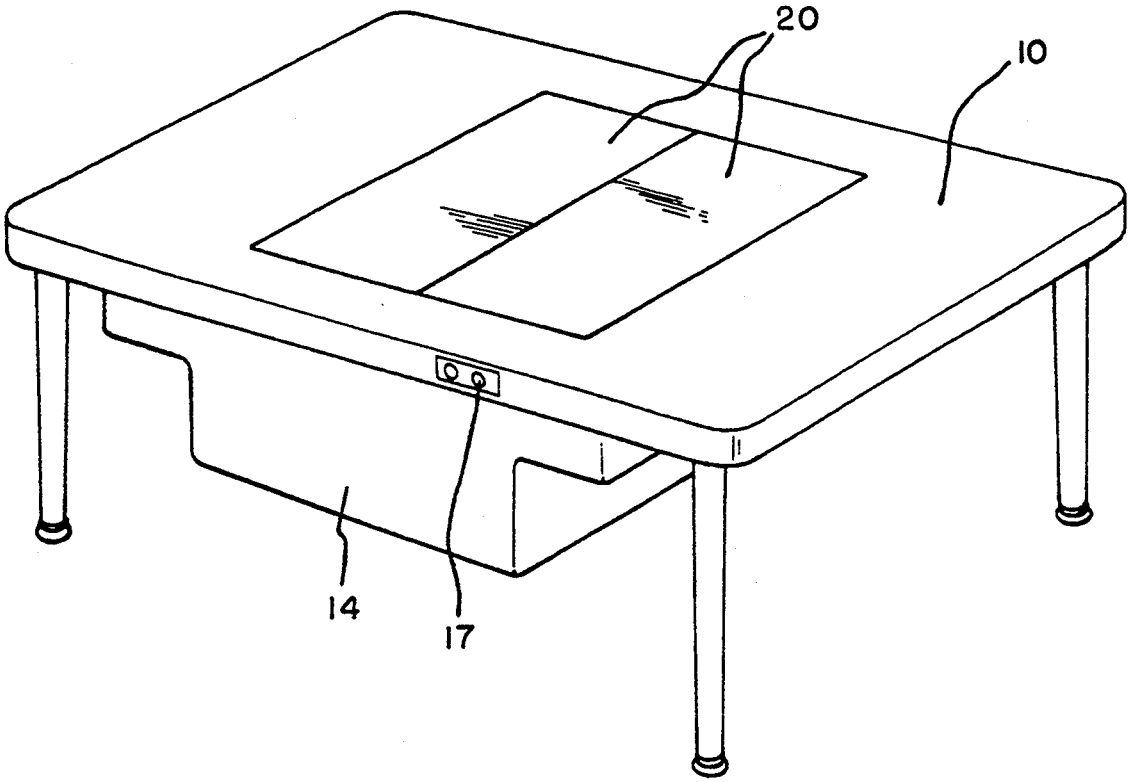
FIG. 1 is a perspective view of the present invention.

FIG. 1 is a perspective view of a table in accordance with the present invention, in which a pair of opening and closing door plates 20 are closed at a center of the table board 10 and coplanar with the table board 10 whereby a refrigerating chamber 14 is closed, and an operating switch 17 is attached at a side of the table board.

Figure 2:
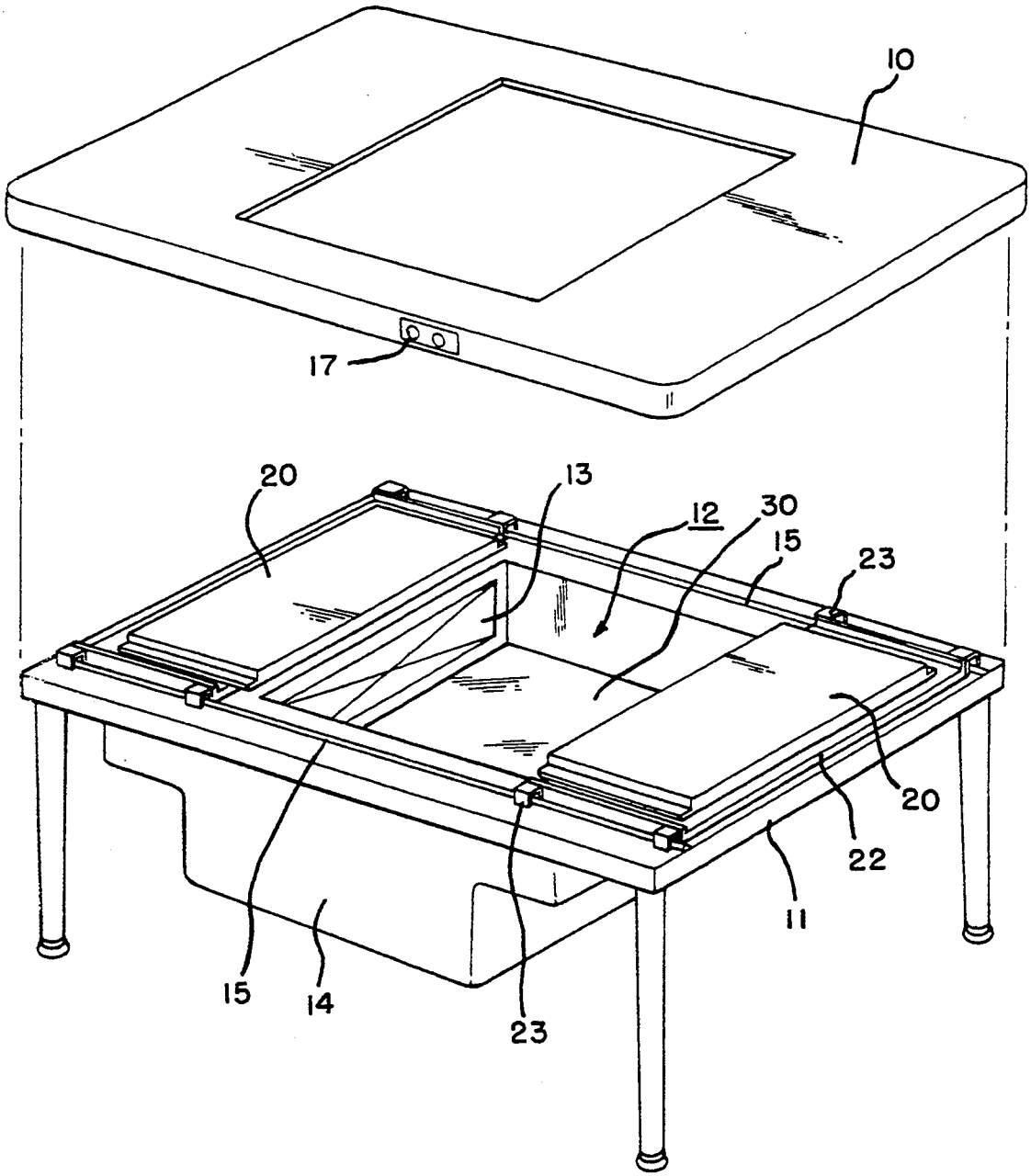
FIG. 2 is a perspective view showing a state in which a table board is disassembled from lower part of the device.

FIG. 2 is an exploded perspective view of the table in a state that the table board 10 is disassembled from a remainder of the device, and it shows a state in which a pair of traveling boards 22 are connected to traveling carriages 23, respectively, at a state in which the traveling boards 22 are placed at both sides of a cavity 12 defined at a central portion of a base board 11. Upon horizontally moving the traveling boards 22 along guide rails 15, the door plates 20 provided on top of the traveling boards 22 are also moved. A refrigerator 13 is provided to a lateral side of the cavity 12, and a moving table 30 may be raised or lowered within the cavity 12 to conceal or reveal the refrigerator 13, respectively.

Figure 3:
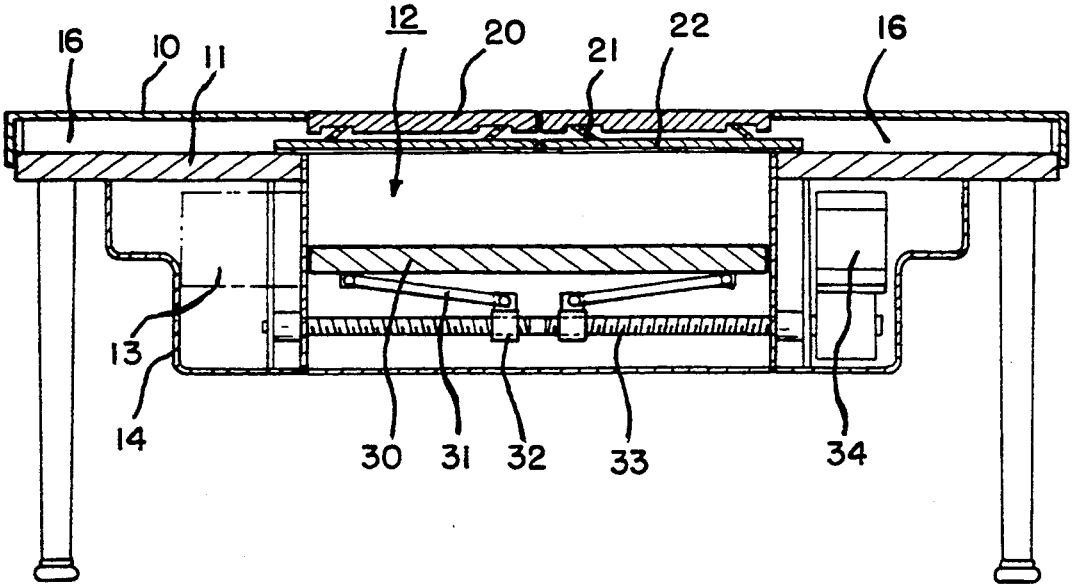
FIG. 3 is a longitudinal cross sectional view of a state in which a moving table of the present invention is dropped down.

FIG. 3 shows a state in which the moving table 30 is dropped down, and it shows a state in which the traveling boards 22 are hinge-coupled respectively by short links 21 to the door plates 20. The table board 10 and the door plates 20 are closed at the same coplanar level, and the moving table 30 is adjusted by moving carriages 32 to make a distance between them to be narrower or wider by moving to the right and left in accordance with rotation of carriage moving threads 33 which are rotated by a motor 34 and formed with opposing direction threads, respectively, at each side, and links 31 hinge-coupled between the moving carriages 32 and the moving table 30 so as to be lifted up and dropped down. The distance between both links 31 is made to be narrower and an angle of the link 31 is inclined mostly whereby the moving table 30 is dropped down.

Figure 4:
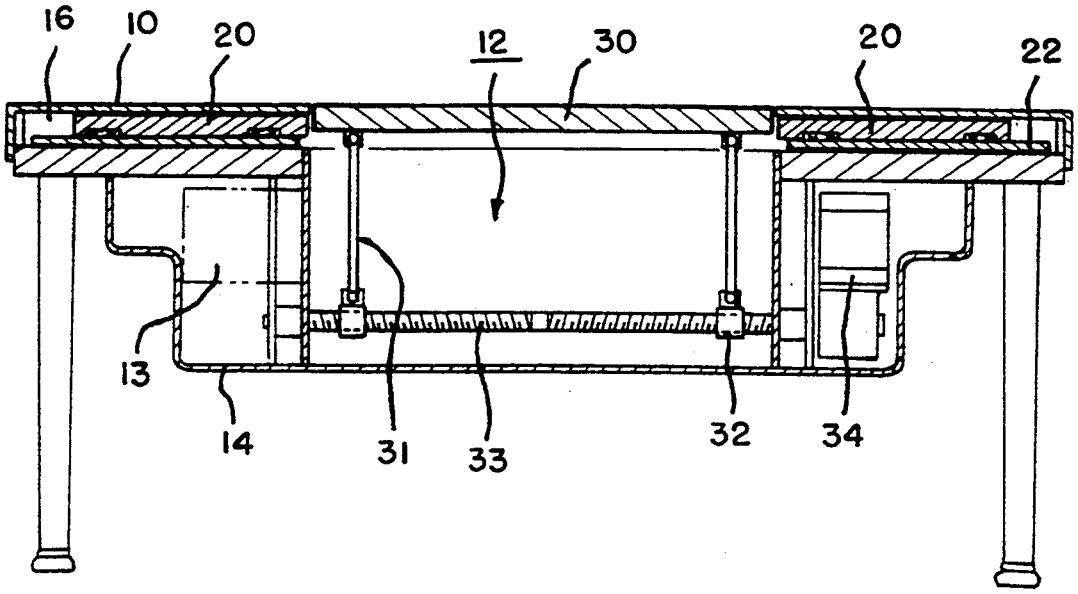
FIG. 4 is a longitudinal cross sectional view of a state in which the moving table of the present invention is lifted up.

FIG. 4 shows a state in which the moving table 30 is lifted up, and wherein the door plates 20 and the traveling boards 22 are contained within guide grooves 16 such that the hinge-coupled short links 21 are flattened against the traveling boards 22, and the links 31 perpendicularly stand to raise the moving table 30 and the moving carriages 32 along the carriage moving threads 33 whereby the moving table 30 is lifted up to the same level as the table board 10.

Figure 5:
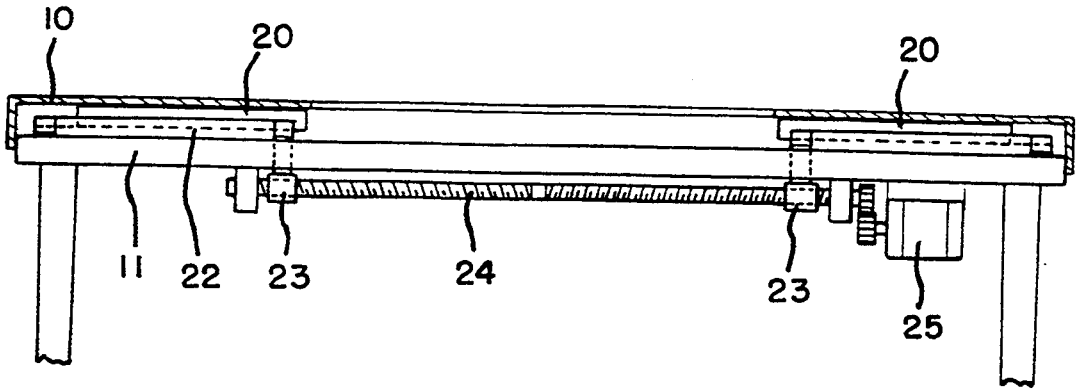
FIG. 5 is a longitudinal cross sectional view of a driving device for opening and closing door plates of the present invention.

FIG. 5 shows a driving device of the opening and closing door plates, and which shows a state in which the traveling carriages 23 of the traveling boards 22 located below the door plates 20 are horizontally traveled along with conveying threads 24 having mutually opposing threads whereby the cavity 12 is exposed, and the traveling carriages 23 are screw-coupled to the conveying threads 24 and are integrally fixed to the traveling boards 22.

Figure 6:
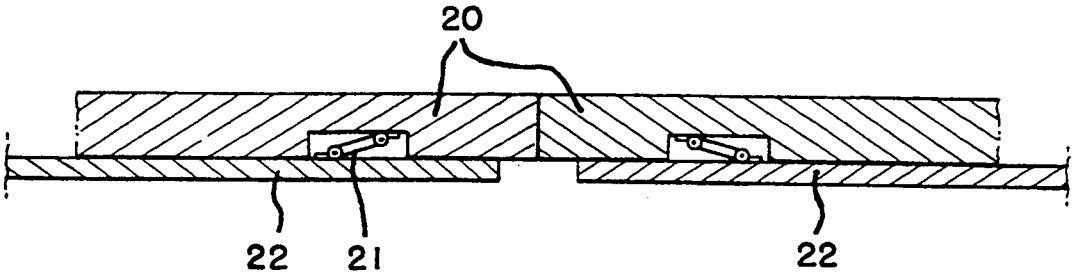
FIG. 6 is a magnified cross sectional view of a state in which the opening and closing door plates are abutted against traveling boards in the present invention.
Figure 7:
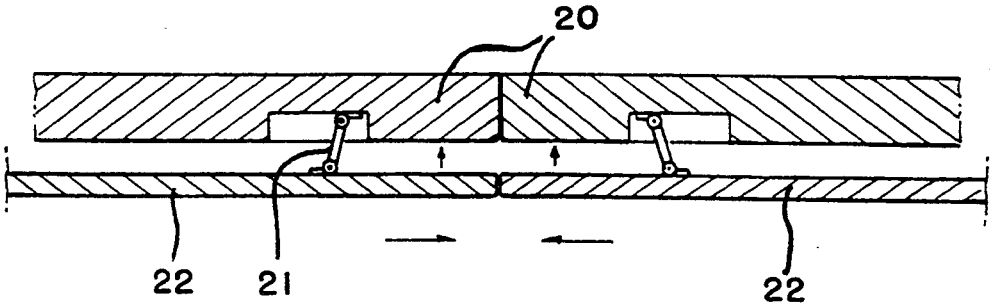
FIG. 7 is a magnified cross sectional view of a state in which the opening and closing door plates are lifted up from the traveling board in the present invention.

FIG. 6 and FIG. 7 show magnified views of the door plates 20, wherein the traveling boards 22 are provided below the door plates 20 so that a bottom surface of the door plates 20 are recessed to receive the short links 21 hinge-coupled at an inclined angle between the door plates 20 and the traveling boards 22. The door plates 20 move in a perpendicular direction with respect to the traveling direction of the traveling boards 22 by the short links 21 whose angles change in accordance with the forward and backward movement of the traveling boards 22. In case of desiring to move the traveling boards 22 backward, the short links 21 are flattened and simultaneously the traveling boards 22 and the door plates 20 are abutted, and when the traveling boards 22 are moved frontward, the protruded door plates 20 are firstly abutted and later the short links 21 are stood perpendicularly by an advancement of the traveling boards 22 and simultaneously a lifting up of the door plates 20 is made whereby a same level as the table board 10 is maintained. Packings are attached to the traveling boards 22 so that the refrigerating chamber can be completely sealed.

Figure 8:
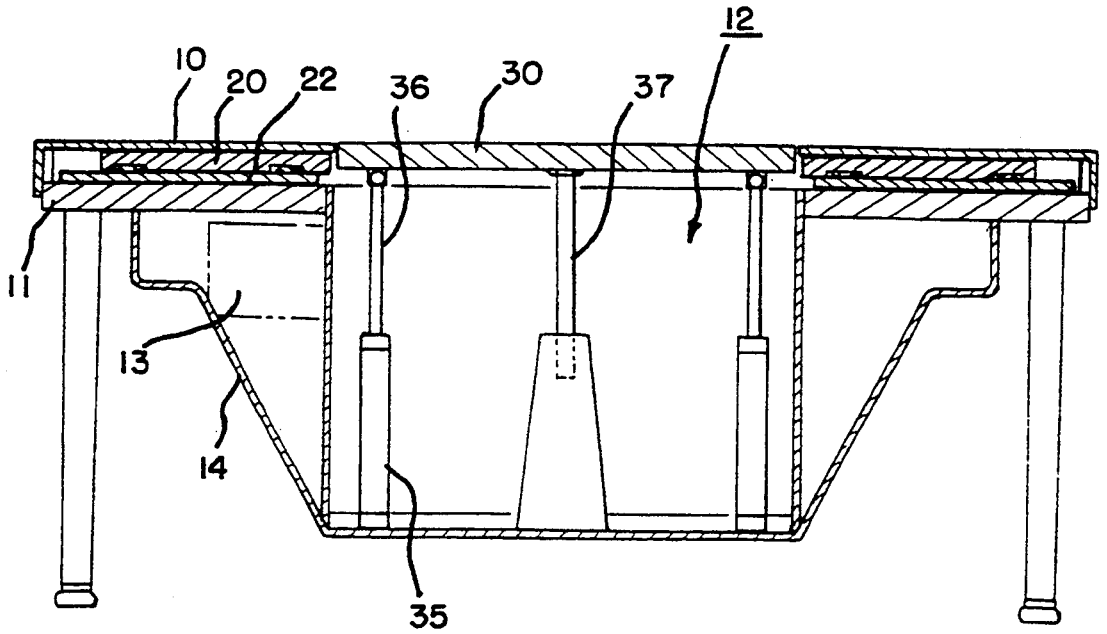
FIG. 8 is another embodiment in which the lifting and dropping device of the moving table of the present invention is operated by cylinders.

FIG. 8 shows another embodiment of the moving table lifting and dropping operation, wherein a lifting and dropping guide bar 37 is provided at a bottom center of the moving table 30 and piston rods 36 are provided at both sides so that the moving table 30 can be lifted up and dropped down by cylinders 35.

Figure 9:
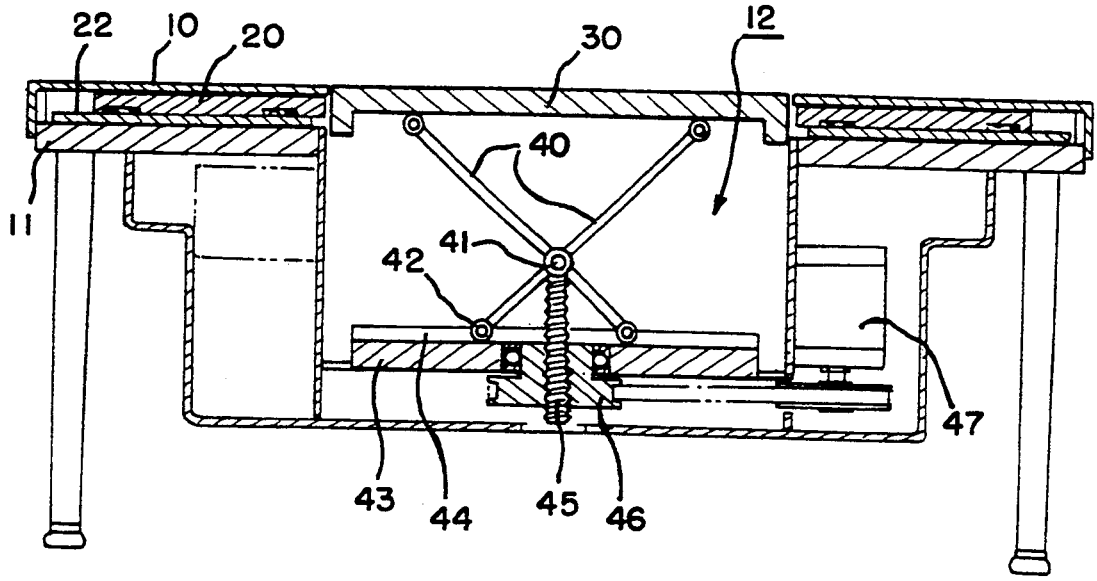
FIG. 9 is still another embodiment of the lifting and dropping device of the moving table of the present invention.

FIG. 9 shows that the lifting and dropping operation of the moving table is made by "X" type operating arms 40, wherein a supporting base 43 is fixed under the moving table 30 and the "X" type operating arms 40 are provided therebetween, so that top end portions of the operating arms 40 are pivotably fixed to a bottom of the moving table 30 and bottom end portions are attached with rollers 42 so as to be moved along guide rails 44 of the supporting base 43, and a lifting and dropping thread 45 is connected to a center shaft 41 of the operating arms 40. In a process for lifting and dropping the lifting and dropping thread 45, a rotating pulley shaft 46 is driven by a motor 47, and an angle of the operating arm 40 is changed so that the lifting and dropping of the moving table 30 occurs.

Figure 10:
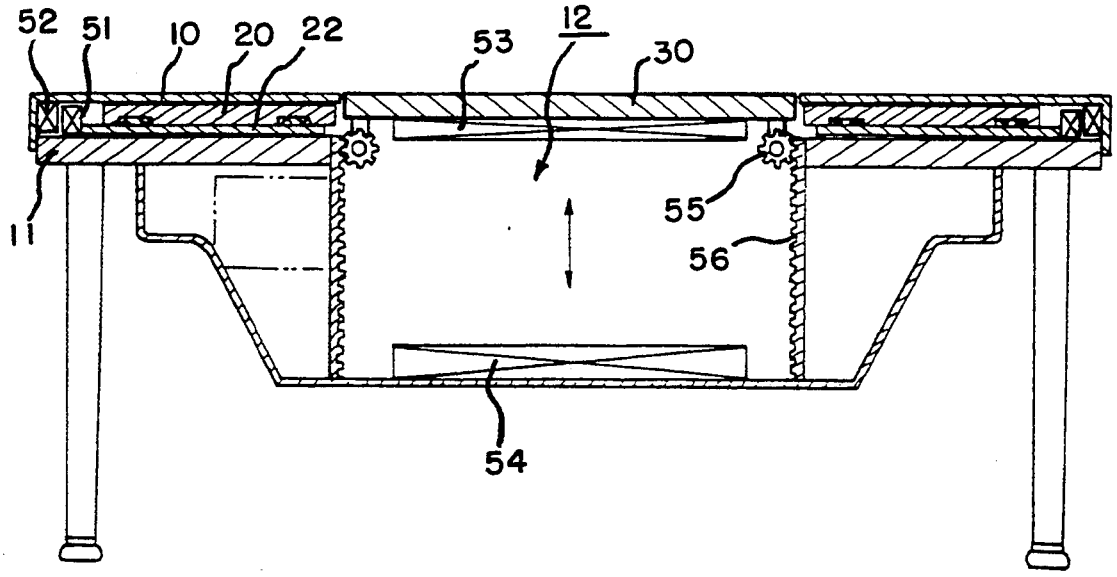
FIG. 10 is further embodiment in which the traveling boards and the moving table are driven by electric magnets in the present invention.

FIG. 10 shows still other embodiment for driving the traveling boards 22 and the moving table 30 by electric magnets, wherein the traveling boards 22 are so made that an electric magnet 51 made of electromagnetic coil is attached at a side which will mutually attract or repulse in accordance with polarity of an electric magnet 52 fixed to a confronting location thereof so that the traveling board 22 is horizontally conveyed. The moving table 30 is so made that an electric magnet 53 is attached to a bottom of the moving table and gears 55 are provided at both side ends so as to be meshed with rack gears 56 respectively within the cavity 12, so that the lifting and dropping of the moving table 30 is made in accordance with polarity of an electric magnet 54 fixed at a bottom thereof, and the gears 55 not only safely lift and drop the moving table but also prevent the moving table 30 from being voluntarily dropped even if an electric power is cut off when the moving table 30 is lifted up.

If the door plates 20 of the present invention are closed, the refrigerator 13 of the refrigerating chamber 14 is operated whereby meals placed on the moving table 30 are refrigerated, and when the opening and closing door plates 20 are opened, the refrigerator 13 stops operating and the moving table 30 is lifted up so as to be able to take a meal at a same level as the table board 10.

That is, at a state shown in FIG. 3, the refrigerator 13 is operated and the meals put on the moving table 30 are refrigerated, and the top portion is completely sealed by the traveling boards 22 whereby cooled air is blocked, and then the refrigerator 13 is stopped from operating when the conveying thread 24 is driven and the door plates 20 are opened. When the traveling carriages 23 of the conveying thread 24 are conveyed to the right and left, the traveling boards 22 are first moved back and simultaneously the links 21 connected to the opening and closing door plates 20 are folded to be inclined so that the opening and closing door plates 20 are abutted against the traveling boards 22 and become contained in the guide grooves.

Thus, when the cavity 12 of the is opened due to movement of the door plates 20, as shown in FIG. 4, the moving carriages 32 are widened to the right and left by the carriage moving threads 33 and simultaneously the moving table 30 maintains the same level as the table board 10, and therefore the taking of a meal becomes easy.

Thus, a series of operations are made in turn in which the refrigerator 13 is stopped to operate as soon as the door plates 20 are opened, the moving table 30 is lifted up when the door plates 20 are completely opened and when the moving table 30 is dropped down, the door plates 20 are closed and the refrigerator 13 is operated. Accordingly, the structure is simple and has an advantage of reducing a meal preparation time for housewives.

What is claimed is:

1. A table comprising:

a table board having an upper planar food serving surface and a lower surface, said table board having an opening formed therethrough;

a base board having an upper surface and a lower surface;

a refrigerating chamber fixed to the lower surface of said base board, said refrigerating chamber including at least one refrigerating element, a cavity for storing food items the cavity having side walls into which the refrigerating element is mounted and a floor surface, a vertically movable table disposed within the cavity for selective movement into a raised food serving position coplanar with the upper surface of said table board or a lowered food storage position within the cavity, traveling boards formed on the upper surface of said base board and below the lower surface of said table board, and door plates mounted on each traveling board, respectively, and substantially movable therewith for selectively opening and closing the opening of said table board;

means for moving the vertically movable table; and means for moving the door plates, wherein the door plates are movable over the opening of the cavity and into the opening of said table board when the movable table is in the lowered food storage position, and movable away from the opening of the cavity and out of the opening of said table board when the movable table is in the raised food serving position.

2. The table according to claim 1, wherein said means for moving the vertically movable table includes a threaded table support rod positioned adjacent a base of the cavity and connected to opposing side walls thereof, the table support rod having mutually opposing threaded portions from a center to opposing ends of said table support rod, a pair of moving carriages screw-coupled to said table support rod, one of each of the moving carriages being coupled to opposing threaded portions of said table support rod, respectively, such that said pair of moving carriages move towards or away from each other according to rotation of said table support rod, a pair of links hinge-coupled between said pair of moving carriages, respectively, and the lower surface of said movable table; and means for rotating said table support rod thereby selectively raising and lowering the vertically movable table into and out of the opening of the cavity and the opening of said table board.

3. The table according to claim 1, wherein said means for moving the door plates include a threaded door plate support rod positioned below and mounted to said base board, the door plate support rod having mutually opposing threaded portions from a center to opposing ends of said door plate support rod, a pair of moving carriages screw-coupled to the door plate support rod, one of each of the moving carriages being coupled to opposing threaded portions of the door plate support rod, respectively, such that said pair of moving carriages move towards or away from each other according to rotation of said door plate support rod, a pair of short links connecting the upper surface of the traveling boards to the lower surface of the door plates, said pair of short links being movable between a perpendicular orientation with respect to the door plates thereby positioning the upper surface of the door plates coplanar with an upper surface of said table board and a horizontal orientation within cut-outs formed within the lower surface of the door plates thereby retracting the door plates into contact with said base board and beneath said table board; and means for rotating said threaded door plate support rod thereby selectively raising and lowering the door plates.

4. The table according to claim 1, wherein said table board includes a pair of guide rails mounted on the upper surface thereof, said traveling boards sliding bidirectionally along said guide rails.

5. The table according to claim 1, wherein said means for moving the vertically movable table includes at least a pair of piston rods having one end thereof mounted to the floor of the cavity and an opposing end thereof mounted to the lower surface of the vertically movable table, and a guide bar vertically mounted between the lower surface of the vertically movable table and the floor of the cavity for guiding a vertical movement of the table.

6. The table according to claim 1, wherein said means for moving the vertically movable table includes a supporting base positioned above the floor of the cavity, guide rails mounted on an upper surface of the supporting base, a pulley member mounted within the supporting base, a lifting and dropping thread which is vertically threaded through the pulley member, X-shaped operating arms having first ends thereof slidable along the guide rails and second ends thereof mounted to the lower surface of the vertically movable table and a pivot point thereof connected to an upper end of the lifting and dropping thread, and means for rotatably actuating the pulley member to thereby rotate the lifting and dropping thread, wherein the pivot point of the X-shaped member is raised and lowered according to rotation of the pulley member, thereby raising and lowering the vertically movable table.

7. The table according to claim 1, wherein said means for moving the vertically movable table includes a first electromagnet positioned on the floor of the cavity, a second electromagnet mounted to the lower surface of the vertically movable table, rack gear members fixed to opposing walls of the cavity, gear members engageable with the rack gear members, respectively and connected to the lower surface of the vertically movable table, and means for polarizing the first electromagnet to selectively attract or repel the second electromagnet, wherein said vertically movable table is raised or lowered according to repulsion or attraction of the first and second electromagnets, respectively.

8. The table according to claim 1, wherein said means for moving the door plates includes first electromagnets fixed to outer lower ends of said table board, second electromagnets fixed to outer ends of the door plates, and means for polarizing the first electromagnets to selectively attract or repel the second electromagnets, wherein the door plates are moved to cover the cavity or retracted to reveal the cavity according to repulsion or attraction of the first and second electromagnets, respectively.

* * * * *